US010591840B2

(12) United States Patent
Kokotov et al.

(10) Patent No.: US 10,591,840 B2
(45) Date of Patent: Mar. 17, 2020

(54) LIQUID ELECTROPHOTOGRAPHIC INKS

(71) Applicant: HP Indigo B.V., Amstelveen (NL)

(72) Inventors: Michael Kokotov, Nes Ziona (IL); Gregory Katz, Nes Ziona (IL); Yaron Grinwald, Nes Ziona (IL); Pavel Sandik, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/082,372

(22) PCT Filed: Apr. 6, 2016

(86) PCT No.: PCT/EP2016/057512
§ 371 (c)(1),
(2) Date: Sep. 5, 2018

(87) PCT Pub. No.: WO2017/174124
PCT Pub. Date: Oct. 12, 2017

(65) Prior Publication Data

US 2019/0064690 A1 Feb. 28, 2019

(51) Int. Cl.

| | |
|---|---|
| ***G03G 9/12*** | (2006.01) |
| ***G03G 9/13*** | (2006.01) |
| ***G03G 9/135*** | (2006.01) |

(52) U.S. Cl.
CPC ..... *G03G 9/135* (2013.01); *G03G 9/122* (2013.01); *G03G 9/1355* (2013.01); *G03G 9/13* (2013.01)

(58) Field of Classification Search
CPC ..... G03G 9/122; G03G 9/135; G03G 13/14
See application file for complete search history.

(56) References Cited

U.S. PATENT DOCUMENTS

| | | | | |
|---|---|---|---|---|
| 5,700,618 | A * | 12/1997 | Faust | G03G 9/08726 430/124.12 |
| 5,749,032 | A | 5/1998 | Landa et al. | |
| 6,153,348 | A | 11/2000 | Kydd et al. | |
| 7,432,033 | B2 | 10/2008 | Chou et al. | |
| 7,736,829 | B2 * | 6/2010 | Silcoff | G03G 9/1355 106/31.6 |
| 7,807,326 | B2 | 10/2010 | Grinwald | |
| 9,046,802 | B2 | 6/2015 | Yoshida et al. | |
| 2005/0141910 | A1 | 6/2005 | Chou et al. | |
| 2010/0103437 | A1 | 4/2010 | Li | |

(Continued)

FOREIGN PATENT DOCUMENTS

| | | |
|---|---|---|
| CN | 104838318 | 8/2015 |
| WO | 2013117219 | 8/2013 |
| WO | 2017148539 | 9/2017 |

OTHER PUBLICATIONS

Diamond, A.S. (ed), Handbook of Imaging Materials. New York: Marcel-Dekker, Inc (2002) pp. 242-247.*

(Continued)

*Primary Examiner* — Christopher D Rodee
(74) *Attorney, Agent, or Firm* — Thorpe North & Western LLP

(57) ABSTRACT

A liquid electrophotographic (LEP) ink can include a liquid ink vehicle, a conductive toner including a conductive pigment and a polymeric binder, and a charge director. The liquid electrophotographic ink can have a conductivity of from 150 to 2000 picoSiemens.

12 Claims, 2 Drawing Sheets

(56) References Cited

U.S. PATENT DOCUMENTS

| | | | | |
|---|---|---|---|---|
| 2011/0217650 | A1* | 9/2011 | Mor | C09D 11/03 430/115 |
| 2011/0261435 | A1* | 10/2011 | Grinwald | G02F 1/167 359/296 |
| 2011/0266347 | A1* | 11/2011 | Grinwald | C09D 11/52 235/451 |
| 2013/0323636 | A1 | 12/2013 | Bar-Haim et al. | |
| 2014/0093284 | A1 | 4/2014 | Liu | |
| 2014/0093822 | A1* | 4/2014 | Deprez | G03G 9/0806 430/115 |
| 2015/0129811 | A1 | 5/2015 | Inbar et al. | |
| 2015/0175826 | A1 | 6/2015 | Mor et al. | |
| 2015/0220010 | A1* | 8/2015 | Grinwald | C09D 11/52 174/257 |
| 2015/0277264 | A1 | 10/2015 | Chang et al. | |
| 2015/0316868 | A1 | 11/2015 | Ganapathiappan et al. | |
| 2018/0074420 | A1* | 3/2018 | Cohen | G03G 8/00 |

OTHER PUBLICATIONS

"Theory and Application of Conductivity" Emerson Process Management Application Data Sheet ADS 43-018/rev.D (Year: 2010).*
International Search Report dated Dec. 14, 2016 for PCT/EP2016/057512.

* cited by examiner

LIQUID ELECTROPHOTOGRAPHIC INKS

BACKGROUND

Electrostatic printing processes typically involve creating an image on a photoconductive surface, applying an ink having charged particles to the photoconductive surface, such that they selectively bind to the image, and then transferring the charged particles in the form of the image to a print substrate.

The photoconductive surface is typically on a cylinder and is often termed a photoimaging plate (PIP). The photoconductive surface is selectively charged with a latent electrostatic image having image and background areas with different potentials. For example, an electrostatic ink composition including charged toner particles in a carrier liquid can be brought into contact with the selectively charged photoconductive surface. The charged toner particles adhere to the image areas of the latent image while the background areas remain clean. The image is then transferred to a print substrate (e.g. paper) directly or, more commonly, by being first transferred to an intermediate transfer member, which can be a soft swelling blanket, and then to the print substrate.

DETAILED DESCRIPTION

Figure 1:
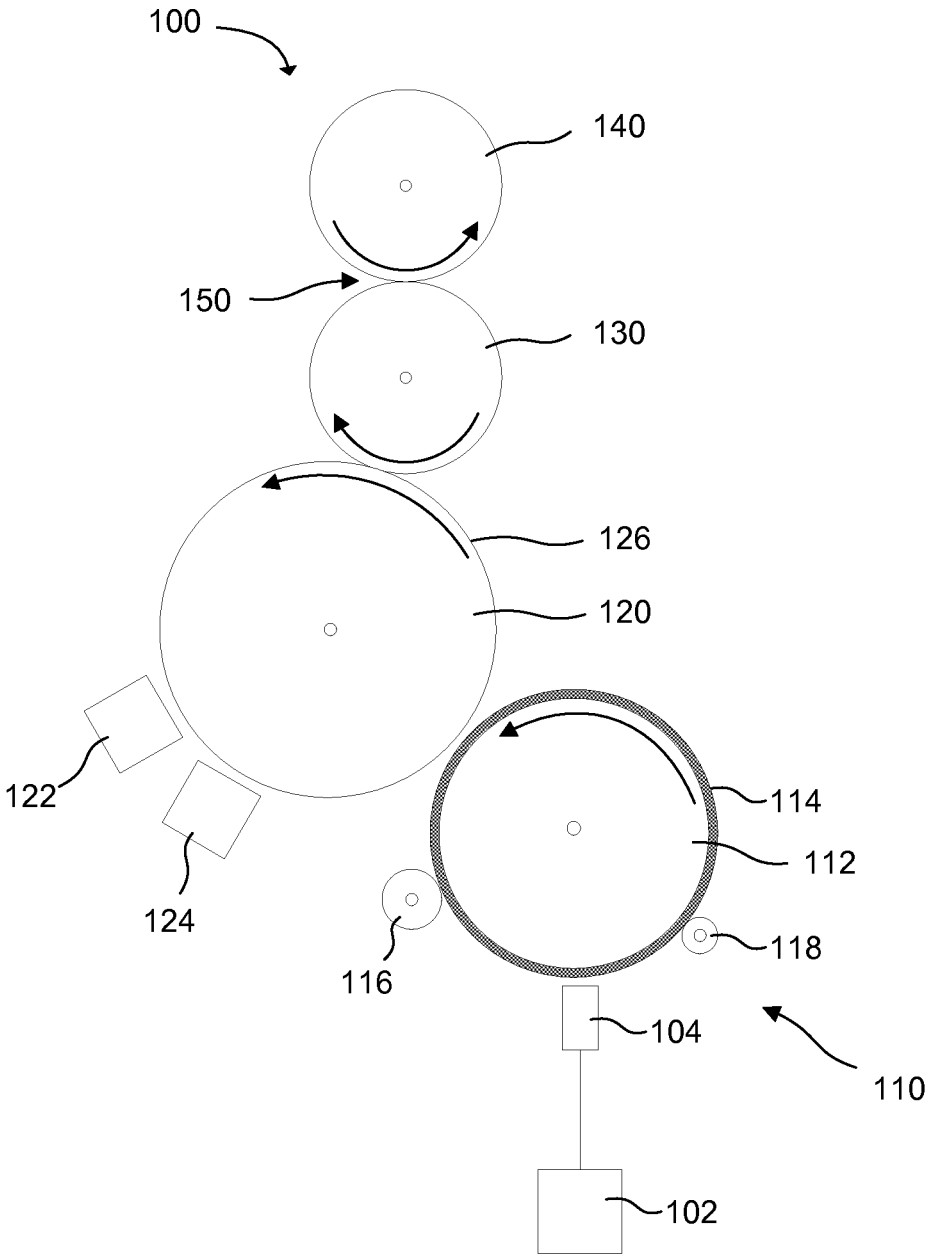
FIG. 1 is a schematic diagram of a liquid electrophotographic (LEP) apparatus in accordance with examples of the present disclosure.

Printing electrically conductive ink particles via liquid electrophotographic (LEP) printing processes can be challenging. For example, the addition of electrically conductive pigments can increase the viscosity of the LEP ink above a desirable or workable range. Further, the electrically conductive nature of the LEP ink particles can disrupt the major electrostatic steps of the LEP printing process. This electrostatic disruption can result in a loss of digitization (e.g., high background) and/or a low thickness of developed ink films. However, these challenges are not necessarily unique to conductive printing. For example, graphical printing can be similarly challenging when metallic pigments are used to achieve a metallic appearance. In this particular case, the deposited ink film may not conduct electricity on a macro scale, but the individual metallic pigments can each conduct an electrical charge and, thus, disrupt the electrostatic steps of the LEP printing process.

Accordingly, the present disclosure describes LEP inks and associated methods that help mitigate or overcome some of the challenges associated with printing conductive ink particles.

In one example, an LEP ink can include a liquid ink vehicle, a conductive toner, and a charge director. The conductive toner can include a conductive pigment and a polymeric binder. In some examples, the conductive pigment and the polymeric binder are ground or milled together in a common conductive toner composition prior to admixing with the charge director and/or the liquid ink vehicle. The LEP ink can have a conductance of from 150 to 2000 picoSiemens.

In another example, a method of manufacturing an LEP ink is described. This method can include dispersing a conductive toner in a liquid ink vehicle to prepare an ink dispersion, wherein the conductive toner includes a conductive pigment and a polymeric binder, in some instances ground or milled together in a common composition. The ink dispersion can be heated to a temperature of about 38° C. to about 48° C. to prepare a heated ink dispersion. A charge director can be added to the heated ink dispersion to achieve a conductance of about 150 to about 2000 picoSiemens.

In another example, a method of printing an electrically conductive pattern is described. This method can include introducing an LEP ink as described herein into a binary ink development (BID) unit of an LEP printer. The BID can include a plurality of rollers having a contact resistance of at least 100 kOhm therebetween. After transferring the LEP ink from the BID, liquid ink vehicle can be evaporated from the LEP ink to prepare an ink film. Ink film can be transferred to a media substrate to form an electrically conductive pattern.

In each of these examples, the conductive pigment can be selected from carbon-based pigments, metallic pigments, or a combination thereof. In some examples, the polymeric binder can be a high adhesive wax resin having a weight average molecular weight (Mw) of from 100 Mw to 20,000 Mw. In some examples, the conductive pigment and polymeric binder can be present in a weight ratio of from 0.1:100 to 95:100. In still other examples, the conductive toner can be present in an amount from about 0.1 wt % to about 5 wt %. In other examples, the charge director and conductive toner are present at a weight ratio of from 0.1:1 to 2:1. In still other examples, the charge director can be present in an amount from about 0.01 wt % to about 7.5 wt %.

When printing, contact resistance can be achieved by coating one of the plurality of rollers with an insulating coating having a coating thickness of from about 2 μm to about 1 mm. In some examples, the insulating coating can include a material selected from parylene, polyurethane, silicone rubber, polytetrafluoroethylene, ceramic, or a combination thereof. In some examples, the ink film is transferred to the media substrate at a pressure of from about 1.0 kg/mm of nip length when rolled to about 1.5 kg/mm of nip length when rolled.

The media substrate can include any suitable media substrate. Non-limiting examples of media substrates can include paper, label paper, plastic film, canvas, composite sheets, composite board, or any other flexible media substrate.

Further, a variety of LEP inks can be used to print an electrically conductive pattern on the media substrate. For example, an LEP ink for printing electrically conductive patterns can include a conductive pigment. Any suitable conductive pigment can be used. For example, conductive pigments can include carbon-based pigments, metallic pigments, the like, and combinations thereof. Non-limiting examples of carbon-based pigments can include carbon black, graphite, carbon nanotubes (CNTs), graphene, the like, and combinations thereof. Where CNTs are used as pigments, the CNTs can include single-walled CNTs, multi-walled CNTs, any other suitable CNT configuration, or a combination thereof. Non-limiting examples of metallic pigments can include aluminum, silver, indium, titanium, tin, antimony, copper, the like, oxides thereof, alloys thereof, or combinations thereof. Additional conductive pigments can include composite structures of metal and non-metal components, mica, core-shell, conductive polymers, the like, or combinations thereof. Any of the recited pigments can be used alone or in combination. In one specific example, the conductive pigment can include CNTs.

The LEP ink can also include a polymeric binder. Any suitable polymeric binder can be used. In some examples, the polymeric binder can be a thermoplastic polymer. In some examples, the polymeric binders can include ethylene acid copolymers; ethylene acrylic acid copolymers; methacrylic acid copolymers; ethylene vinyl acetate copolymers; copolymers of ethylene acid and alkyls, acrylic acid and alkyls, or methacrylic acid and alkyls (with carbon chain lengths between 1 and 20 carbons, inclusive); esters of methacrylic acid or acrylic acid; polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g., copolymer of acrylic or methacrylic acid and at least one alkyl ester of acrylic or methacrylic acid where the alkyl is from 1 to about 20 carbon atoms, such as methyl methacrylate or ethylhexylacrylate); ethylene-acrylate terpolyrners; ethylene-acrylic esters; maleic anhydride (MAH) or glycidyl methacrylate (GMA) terpolyrners; low molecular weight ethylene-acrylic acid ionomers (i.e., those having a molecular weight less than 1000 amu); or combinations thereof. In one example, the polymeric binder is selected from the Nucrel® or Bynel® family of polymers (available from DuPont Company, Wilmington, Del., USA, e.g., Nucrel® 403, Nucrel® 407, Nucrel® 609HS, Nucrel® 908HS, Nucrel® 1202HC, Nucrel® 30707, Nucrel® 1214, Nucrel® 903, Nucrel® 3990, Nucrel® 910, Nucrel® 925, Nucrel® 609, Nucrel® 599, Nucrel® 960, Nucrel® RX 76, Nucrel® 2806, Bynel® 2002, Bynel® 2014, Or Bynel® 2020), the ACLYN® family of polymers (available from Honeywell International, Inc., Morristown, N.J., USA, e.g., Aclyn® 201, Aclyn® 246, Aclyn® 285, or Aclyn® 295), or the Lotader® family of polymers (available from Arkema, Inc., King of Prussia, Pa., USA e.g., Lotader® 2210, Lotader® 3430, or Lotader® 8200). In some instances, the polymeric binder can have one or more functional groups such as carboxylic acid, ester, amide, amine, urea, anhydride, aromatic, or halogen based groups. Additionally, in some examples, any of the above listed polymeric binders can be used alone or in combination with any other polymeric binder listed above.

The polymeric binder can be a wax resin. In some examples, the wax resin can be a low molecular weight, high-adhesive wax resin. In some examples, the wax resin can have a weight average molecular weight (Mw) of from about 100 Mw to about 20,000 Mw, about 500 Mw to about 10,000 Mw, or about 1000 Mw to about 5000 Mw. Any suitable synthetic or natural wax resin can be used. In some examples, the wax resin can be a polyolefin (e.g. polyethylene, polypropylene, etc.) wax resin, or a copolymer thereof. Non-limiting examples of commercially available wax resins can include A-C® 575 wax resin (copolymer of polyethylene grafted with maleic anhydride provided as a powder available from Honeywell in Morristown, N.J.), Aclyn® 295 wax resin (ethylene-acrylic acid zinc ionomer provided as granules available from Honeywell in Morristown, N.J.), Antaron™ WP-660 wax resin (vinyl pyrrolidone/triacontene copolymer provided as flakes available from International Specialty Products in Wayne, N.J.), the like, or combinations thereof.

The conductive pigment and polymeric binder can be combined together to prepare a conductive toner. This can be accomplished by grinding or milling to the conductive pigment and polymeric binder together to form conductive toner particles, or by any other suitable process. This process can be carried out prior to admixing with the ink vehicle and/or the charge director. Thus, a homogenous milled admixture of the conductive pigment and polymeric binder is prepared in this example for admixing with other ingredients. In some examples, the conductive toner can have a weight ratio of conductive pigment to polymeric binder of from about 0.1:100 to about 95:100, from about 0.5:100 to about 90:100, or from about 1:100 to about 85:100.

The conductive toner can be dispersed in a variety of liquid ink vehicles to prepare an ink dispersion. In some examples, the liquid ink vehicle can include one or more substituted or unsubstituted hydrocarbons wherein the hydrocarbon can be linear, cyclic, or branched and can be substituted with any functional group. Some specific examples of such hydrocarbons can include, but are not limited to, dielectric liquids, non-oxidative water immiscible liquids, paraffins, isoparaffins, or oils.

In one example, the liquid ink vehicle can include, but is not limited to, linear, branched, and cyclic alkanes having from about 6 to about 100 carbon atoms, inclusive; hydrocarbons having from 6 to 14 carbon atoms, inclusive; cycloalkanes having from 6 to 14 carbon atoms, inclusive (e.g., n-hexanes, heptanes, octane, dodecane, cyclohexane, etc.); t-butylbenzene; 2,2,4-trimethylpentane; isoparaffinic hydrocarbons; paraffinic hydrocarbons; aliphatic hydrocarbons; de-aromatized hydrocarbons; halogenated hyrdrocarbons; cyclic hydrocarbons; functionalized hydrocarbons; or combinations thereof. Specific examples of oil can include, but are not limited to, silicone oil, soy bean oil, vegetable oil, plant extracts, or combinations thereof. Specific examples of paraffins and isoparaffins include those in the Isopar® family (Exxon Mobil Corporation, Fairfax, Va., USA), including, but not limited to, ISOPAR® G, ISOPAR® H, ISOPAR® K, ISOPAR® L, or ISOPAR® M. In other examples, other hydrocarbons that can be used as the liquid ink vehicle include those bearing the trade name Soltrol® (available from Chevron Phillips Chemical Company, The Woodlands, Tex., USA) or Shellsol® (available from Shell Chemicals, Eschborn, Del., USA).

It is noted that the use of a conductive toner in the ink dispersion can cause the viscosity of the ink dispersion to increase beyond a desirable or reasonably workable range. Thus, the ink dispersion can be heated to a temperature of from about 34° C. to about 50° C., about 38° C. to about 48° C., or about 40° C. to about 45° C. This increased temperature can help reduce the viscosity of the ink dispersion to a more desirable or workable viscosity.

Once the ink dispersion is heated to a suitable temperature, the ink dispersion can be charged by adding a suitable amount of charge director/charging agent. In some examples, charge director/charging agent can be added to the ink dispersion to achieve a conductance of the LEP ink of about or greater than about 150 picoSiemens to about 2000 picoSiemens, about or greater than about 150 picoSiemens to about 1000 picoSiemens, about 1000 picoSiemens to about 2000 picoSiemens, about 175 picoSiemens to about 1900 picoSiemens, or about 200 picoSiemens to about 1800 picoSiemens. In some examples, there can be a weight ratio of charge director to conductive toner particles (i.e. combined conductive pigment and polymeric binder) of from about 0.1:1 to about 2:1, or about 0.25:1 to about 1.5:1. In some examples, the charge director can be present in the LEP ink in an amount from about 0.01 wt % to about 7.5 wt %, about 0.05 wt % to about 2 wt %, about 0.1 wt % to about 1.5 wt %, or about 0.5 wt % to about 1 wt %.

Any suitable charge director can be used, either alone or in combination. A charge director can be added to an LEP ink to impart a charge of a desired polarity and/or maintain sufficient electrostatic charge on the various particles of the LEP ink. The charge director can include ionic compounds, such as, but not limited to, metal salts of fatty acids, metal salts of sulfo-succinates, metal salts of oxyphosphates, metal salts of alkyl-benzenesulfonic acid, metal salts of aromatic carboxylic acids or sulfonic acids, as well as zwitterionic and non-ionic compounds, such as polyoxyethylated alkylamines, lecithin, polyvinylpyrrolidone, organic acid esters of polyvalent alcohols, etc. The charge director can be selected from, but is not limited to, oil-soluble petroleum sulfonates (e.g. neutral Calcium Petronate™, neutral Barium Petronate™, and basic Barium Petronate™), polybutylene succinimides (e.g. Oloa™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. The sulfonic acids can include, but are not limited to, alkyl sulfonic acids, aryl sulfonic acids, and sulfonic acids of alkyl succinates (e.g. see WO 2007/130069). The charge director can impart a negative charge or a positive charge on the resin-containing particles of an electrostatic ink composition.

The charge director can include a sulfosuccinate moiety of the general formula $[R_1—O—C(O)CH_2CH(SO_3^-)OC(O)—O—R_2]$, where each of $R_1$ and $R_2$ is an alkyl group. In some examples, the charge director can include nanoparticles of a simple salt and a sulfosuccinate salt of the general formula $MA_n$, wherein M is a metal, n is the valence of M, and A is an ion of the general formula $[R_1—O—C(O)CH_2CH(SO_3^-)OC(O)—O—R_2]$, where each of $R_1$ and $R_2$ is an alkyl group, or other known charge directors. For example, a sulfosuccinate salt of the general formula $MA_n$ is an example of a micelle forming salt. The charge director can be substantially free or free of an acid of the general formula HA, where A is as described above. The charge director can include micelles of said sulfosuccinate salt enclosing at least some of the nanoparticles. The charge director can include at least some nanoparticles having a size of 200 nm or less, in some examples 2 nm or more. In this context, simple salts are salts that do not form micelles by themselves, although they can form a core for micelles with a micelle forming salt. The ions constructing the simple salts are all hydrophilic. The simple salt can include a cation selected from Mg, Ca, Ba, $NH_4$, tert-butyl ammonium, $Li^+$, and $Al^{+3}$, or from any sub-group thereof. The simple salt can include an anion selected from $SO_4^{2-}$, $PO^{3-}$, $NO_3^-$, $HPO_4^{2-}$, $CO_3^{2-}$, acetate, trifluoroacetate (TFA), $Cl^-$, Bf, $F^-$, $ClO_4^-$, and $TiO_3^{4-}$, or from any sub-group thereof. The simple salt can be selected from $CaCO_3$, $Ba_2TiO_3$, $Al_2(SO_4)$, $A1(NO_3)_3$, $Ca_3(PO_4)_2$, $BaSO_4$, $BaHPO_4$, $Ba_2(PO_4)_3$, $CaSO_4$, $(NH_4)_2CO_3$, $(NH_4)_2SO_4$, $NH_4OAc$, Tert-butyl ammonium bromide, $NH_4NO_3$, LiTFA, $Al_2(SO_4)_3$, $LiClO_4$ and $LiBF_4$, or any sub-group thereof. The charge director can further include basic barium petronate (BBP).

In the formula $[R_1—O—C(O)CH_2CH(SO_3^-)OC(O)—O—R_2]$, in some examples, each of $R_1$ and $R_2$ is an aliphatic alkyl group. In some examples, each of $R_1$ and $R_2$ independently is a $C_{6-25}$ alkyl. In some examples, said aliphatic alkyl group is linear. In some examples, said aliphatic alkyl group is branched. In some examples, said aliphatic alkyl group includes a linear chain of more than 6 carbon atoms. In some examples, $R_1$ and $R_2$ are the same. In some examples, at least one of $R_1$ and $R_2$ is $C_{13}H_{27}$. In some examples, M is Na, K, Cs, Ca, or Ba.

In some examples, the charge director can include (i) soya lecithin, (ii) a barium sulfonate salt, such as basic barium petronate (BPP), and (iii) an isopropyl amine sulfonate salt. Basic barium petronate is a barium sulfonate salt of a 21-26 hydrocarbon alkyl, and can be obtained, for example, from Chemtura. An example isopropyl amine sulphonate salt is dodecyl benzene sulfonic acid isopropyl amine, which is available from Croda.

The resulting LEP ink, including a liquid vehicle, conductive toner, charge director, and any other suitable ingredients, can be used to print an electrically conductive pattern. Turning now to FIG. 1, an LEP apparatus 100 is illustrated to assist in understanding certain aspects of the present disclosure, but is not intended to be limiting. The LEP ink can be formulated and placed in an ink tank or reservoir 102. Once therein, the LEP ink can be pumped or otherwise transferred from the ink tank to a binary ink development (BID) unit, represented generally as feature 110. In one specific example, the LEP ink can be transferred to a spray assembly 104, or other suitable component, of the BID unit, which can be configured to transfer LEP ink to a developer roller 112 of the BID unit.

The BID unit 110 can be configured in any suitable way and can have any suitable number of rollers or other components (such as squeegees, etc.). In some examples, the BID can include a single roller, such as developer roller 112. In other examples, the BID unit can include additional rollers, such as squeegee roller 116, cleaner roller 118, and any other suitable rollers (i.e. a sponge roller, a squeeze roller, etc.). The BID unit can include a number of other features in addition to or in place of the BID components listed.

As previously described, the spray assembly 104, or other suitable apparatus, can transfer LEP ink to the developer roller 112. Once transferred to the developer roller, the LEP ink can undergo a gradual concentrating process. For example, liquid ink vehicle can be evaporated from the LEP ink to form an ink film on the developer roller. In the ink film, the conductive toner can reach a concentration of from about 10 wt % to about 25 wt %, about 12 wt % to about 22 wt %, or about 15 wt % to about 20 wt %. In some examples, the ink film can have a thickness on the developer roller of from about 0.2 μm to about 20 μm, about 0.5 μm to about 15 μm, or about 1 μm to about 10 μm.

In some examples, the developer roller 112 can be spaced proximate to, but apart from, a photoconductor drum or photoimaging plate (PIP) 120. In other examples, the developer roller can be configured to contact or to temporarily come into contact with the photoconductor drum.

The photoconductor drum 120 can be configured in any suitable way. For example, the photoconductor drum can include a photoconductive material disposed on a surface 126 thereof. In this particular example, the photoconductor drum is configured to rotate in a counter-clockwise direction, like the developer roller 112. In other examples, the developer roller can be configured to rotate in a direction opposite the photoconductor drum. A charging element 122 can be associated with the photoconductor drum to electrically charge the surface.

To facilitate the transfer of ink film from the developer roller 112 to the photoconductor drum 120, the developer roller, and optionally additional rollers or components, of the BID unit 110 can be electrically charged at a different potential relative to the photoconductor drum 120. Under baseline operating conditions, these different electrical potentials can be configured to prevent transfer of ink film from the developer roller. However, as the photoconductor drum rotates in a counter-clockwise direction from the charging element, an imaging element 124 can be positioned to expose the surface of the photoconductor drum to light. The light can cause a re-arrangement of the electrical charge on the surface 126 of the photoconductor drum to form an image area. The re-arrangement of the electrical charge within the image area can be configured to induce transfer of ink film from the developer roller to the image area at the exclusion of non-image areas. Thus, the photoconductor drum can receive ink film from the developer roller to form an image or pattern at the image area.

However, because of the high conductance of the LEP ink described herein, the electrostatics of the LEP printing process can be disrupted. This electrostatic disruption can result in a loss of digitation in the printed image or pattern. Therefore, one or more BID rollers can be modified such that there is a contact resistance between each BID roller of at least 100 kOhm, 120 kOhm, or 150 kOhm. In some examples, this level of contact resistance can be achieved by coating one or more of the BID rollers with an insulating coating, such as insulating coating 114. The coating can be provided at a coating thickness of from about 2 μm to about 1000 μm, about 3 μm to about 500 μm, 4 μm to about 100 μm, or about 5 μm to about 20 μm.

Various materials can be used to coat the BID rollers. Non-limiting examples of suitable materials, can include parylene, polyurethane, silicone rubber, polytetrafluoroethylene, ceramic, the like, and combinations thereof. Any other suitable resistive or insulating material can also be used. It is noted that not all BID rollers need to be coated to achieve a resistance of at least 100 kOhm therebetween, as is illustrated in FIG. 1. Thus, in some examples, only one BID roller is coated. In other examples, a plurality of BID rollers can be coated. In other examples, all BID rollers can be coated.

By maintaining a contact resistance of at least 100 kOhm, ink film can be transferred from the developer roller 112 to the photoconductor drum 120 with minimal loss of digitation. From the photoconductor drum, the ink film can be transferred to a media substrate via a variety of LEP printing techniques, as are well known in the art. In one non-limiting example, the ink film can be transferred directly to a media substrate from the photoconductor drum. In other examples, the ink film can be transferred to an intermediate roller or hot blanket roller 130 before transferring the ink film to a media substrate. In some examples, the intermediate roller can be heated to a temperature of from about 90° C. to about 150° C., about 100° C. to about 140° C., or about 120° C. to about 130° C. Heating the intermediate roller at an elevated temperature can evaporate additional liquid ink vehicle from the ink film. This process can increase the tackiness of the ink film and facilitate the transfer of the ink film from the intermediate roller to the media substrate.

Depending on the configuration of the LEP printer, the photoconductor drum 120 can be positioned proximate to a pressure roller 140 or an intermediate roller 130. As illustrated in FIG. 1, an intermediate roller is positioned proximate to the photoconductor drum and is configured to rotate in the opposite direction as the photoconductor drum (i.e. in a clockwise direction). A pressure roller is also positioned proximate the intermediate roller to facilitate transfer of the ink film from the intermediate roller to a media substrate. The pressure roller is configured to rotate in an opposite direction from the intermediate roller (i.e. in a counter-clockwise direction). The boundary or area of contact between the intermediate roller and the pressure roller defines or forms a nip 150 for receiving a media substrate. As will be apparent to one skilled in the art, the nip extends into the page and follows the entire area of contact between the intermediate roller and the pressure roller. As the media substrate passes through the nip, the ink film is transferred from the intermediate roller to the media substrate. In an alternative example, the pressure roller can be positioned proximate the photoconductor drum to facilitate the direct transfer of the ink film from the photoconductor drum to the media substrate. In this example, the nip would be formed at the boundary or area of contact between the photoconductor drum and the pressure roller and the pressure roller can be configured to rotate in an opposite direction to the photoconductor drum (in this example a clockwise direction).

In some examples, transfer of the ink film from the photoconductor drum 120 or intermediate roller 130 to the media substrate can be accomplished using increased pressure. In some cases, the increased pressure can increase the electrical contact between the conductive pigment and the polymeric binder of the conductive toner. Accordingly, in some examples, a conductive LEP ink can be transferred to a media substrate at a pressure of from about 1.0 kg/mm of nip length to about 1.5 kg/mm of nip length, or about 1.2 kg/mm of nip length to about 1.4 kg/mm of nip length, or at a pressure greater than 1.2 kg/mm of nip length.

It is noted that the ink film can be transferred in an incremental process. For example, a portion or layer of the ink film can be transferred to the media substrate per revolution of the photoconductor drum 120 or intermediate roller 130. In some examples, each of the incrementally transferred layers can have a thickness of from about 0.1 μm to about 1 μm. In other examples, the entire ink film on the photoconductor drum or intermediate roller can be transferred in a single event, rather than via an incremental process.

The printed feature on the media substrate can include an electrically conductive pattern or patterns. Such electrically conductive patterns can be adapted for a number of applications, including graphical and/or functional applications. Non-limiting examples of functional applications can include smart packaging, smart devices, the like, and combinations thereof. Other suitable applications will be apparent to those skilled in the art, and are considered within the scope of the current description.

Figure 2:
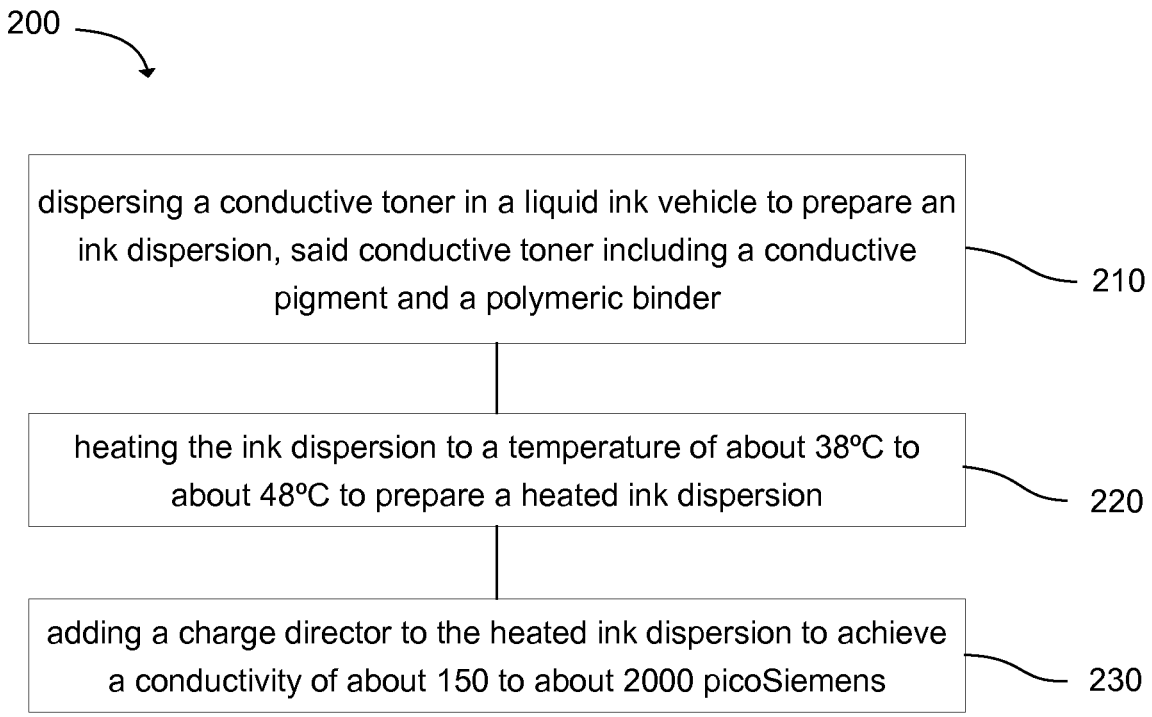
FIG. 2 depicts a method of manufacturing an LEP ink in accordance with examples of the present disclosure.

Turning now to FIG. 2, a method 200 of manufacturing an LEP ink is depicted. In some examples, the LEP ink can be used to print an electrically conductive pattern. The method can include dispersing 210 a conductive toner in a liquid ink vehicle to prepare an ink dispersion. The conductive toner can include a conductive pigment and a polymeric binder. Additional steps include heating 220 the ink dispersion to a temperature of about 38° C. to about 48° C. to prepare a heated ink dispersion, and adding 230 a charge director to the heated ink dispersion to achieve a conductivity conductance of about 150 to about 2000 picoSiemens.

Figure 3:
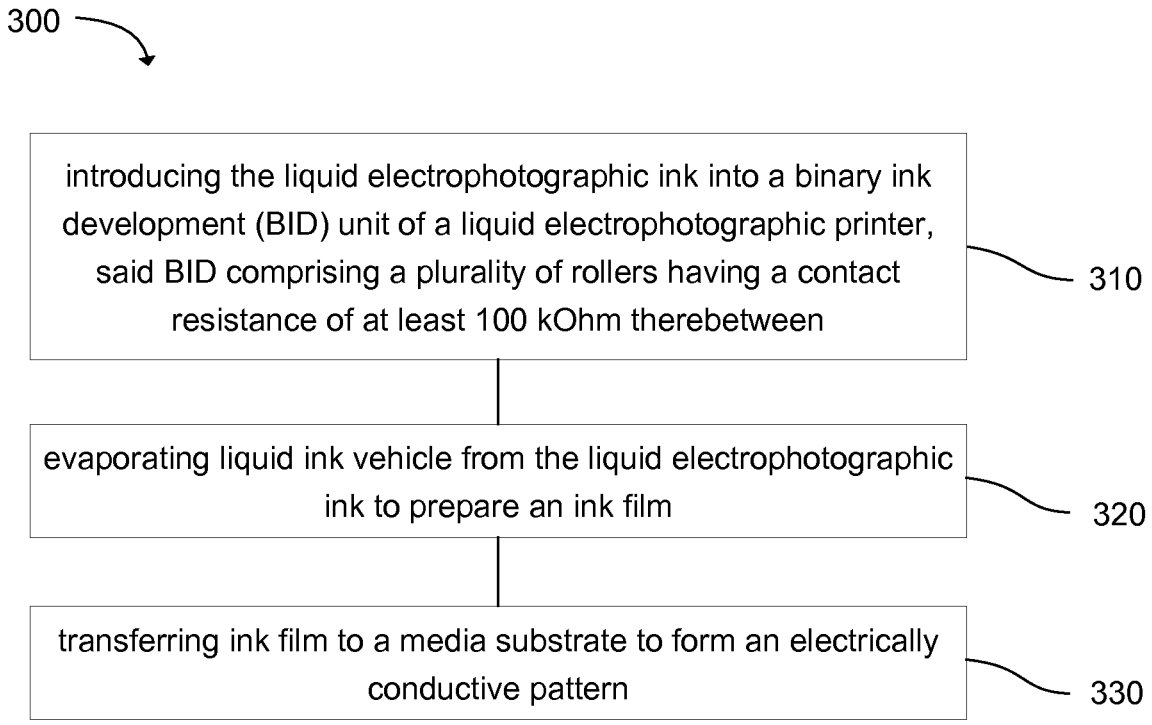
FIG. 3 depicts a method of printing an electrically conductive pattern by LEP printing in accordance with some examples of the present disclosure.

FIG. 3 depicts a method 300 of printing an electrically conductive pattern by LEP printing. The method includes introducing 310 an LEP ink (as described herein) into a binary ink development (BID) unit of an LEP printer. The BID can include a plurality of rollers having a contact resistance of at least 100 kOhm therebetween. Additional steps include evaporating 320 liquid vehicle from the LEP ink to prepare an ink film, and transferring 330 the ink film to a media substrate to form an electrically conductive pattern.

It is noted that, as used in this specification and the appended claims, the singular forms "a," "an," and "the" include plural referents unless the content clearly dictates otherwise.

"Substrate" or "media substrate" includes any base material that can be coated in accordance with examples of the present disclosure, such as film base substrates, polymer substrates, conventional paper substrates, photobase substrates, offset media substrates, and the like. Further, precoated and film coated substrates can be considered a "substrate" that can be likewise be coated in accordance with examples of the present disclosure.

As used herein, the term "about" is used to provide flexibility to a numerical range endpoint by providing that a given value may be "a little above" or "a little below" the endpoint. The degree of flexibility of this term can be dictated by the particular variable and can be determined based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight ratio range of about 1 wt % to about 20 wt % should be interpreted to include not only the explicitly recited limits of 1 wt % and about 20 wt %, but also to include individual weights such as 2 wt %, 11 wt %, 14 wt %, and sub-ranges such as 10 wt % to 20 wt %, 5 wt % to 15 wt %, etc.

As a further note, in the present disclosure, it is noted that when discussing the LEP ink, the method of manufacturing the LEP ink, and the method of printing an electrically conductive pattern, each of these respective discussions can be considered applicable to each of these examples, whether or not they are explicitly discussed in the context of that example. Thus, for example, in discussing details about the LEP ink per se, such discussion also refers to the method of manufacturing and the method of printing an electrically conductive pattern, and vice versa.

What is claimed is:

1. A liquid electrophotographic ink, comprising:
a liquid ink vehicle;
a conductive toner, said conductive toner including a conductive pigment and a polymeric binder; and
a charge director,
wherein the charge director and the conductive toner are present at a weight ratio of from 0.1:1 to 2:1; and
wherein the liquid electrophotographic ink has a conductance of from 150 to 2000 picoSiemiens.

2. The liquid electrophotographic ink of claim 1, wherein the conductive pigment is a carbon-based pigment, a metallic pigment, or a combination thereof.

3. The liquid electrophotographic ink of claim 1, wherein the polymeric binder is a wax resin having a weight average molecular weight of from 100 Mw to 20,000 Mw.

4. The liquid electrophotographic ink of claim 1, wherein the conductive pigment and polymeric binder are ground or milled together to form the conductive toner particles, and the conductive pigment to polymeric binder are present at a weight ratio of from 0.1:100 to 95:100.

5. The liquid electrophotographic ink of claim 1, wherein the conductive toner is present in an amount from about 0.1 wt % to about 5 wt %.

6. The liquid electrophotographic ink of claim 1, wherein the charge director is present in an amount from about 0.01 wt% to about 7.5 wt%.

7. A method of manufacturing the liquid electrophotouraphic ink of claim 1, comprising:
dispersing the conductive toner in the liquid ink vehicle to prepare an ink dispersion;
heating the ink dispersion to a temperature of about 38° C. to about 48° C. to prepare a heated ink dispersion; and
adding the charge director to the heated ink dispersion to form the liquid electmphotographic ink.

8. The method of claim 7, wherein the conductive pigment and polymeric binder are ground or milled together to form the conductive toner particles prior to admixing with the liquid ink vehicle, and wherein the conductive pigment to polymeric binder are present in the liquid electrophotographic ink at a weight ratio of from 0.1:100 to 95:100.

9. The method of claim 7, wherein the conductive toner is present in the liquid electrophotographic ink in an amount from about 0.1 wt % to about 5 wt %, and wherein the charge director is present in the liquid electrophotographic ink in an amount from about 0.01 wt % to about 7.5 wt %.

10. The liquid electrophotographic ink of claim 1, wherein the liquid electrophotographic ink has a conductance of from 1000 picoSiemens to 2000 picoSiemens.

11. The liquid electrophotographic ink of claim 1, wherein the charge director and the conductive toner are present at a weight ratio of from 0.25:1 to 1.5:1.

12. The liquid electrophotographic ink of claim 1, wherein the charge director and the conductive toner are present at a weight ratio of from 1.5:1 to 2:1.

* * * * *